US006176463B1

(12) United States Patent
Röck

(10) Patent No.: US 6,176,463 B1
(45) **Date of Patent: *Jan. 23, 2001**

(54) CEILING FORMWORKING SYSTEM FOR FORMING CEILINGS

(75) Inventor: Ernst Röck, Amstetten (AT)

(73) Assignee: Doka Industrie GmbH (AT)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/421,074

(22) Filed: Apr. 13, 1995

(30) Foreign Application Priority Data

Apr. 21, 1994 (DE) ..... 44 13 931

(51) Int. Cl.[7] ..... E04G 11/48
(52) U.S. Cl. ..... 249/18; 249/53 R; 249/210
(58) Field of Search ..... 249/13, 18, 28, 249/53 R, 210

(56) References Cited

U.S. PATENT DOCUMENTS 3,778,019 * 12/1973 Stegmeier ..... 249/189
4,106,256 * 8/1978 Cody ..... 249/28
4,790,113 * 12/1988 Gregory ..... 249/28

FOREIGN PATENT DOCUMENTS 1823069 12/1960 (DE) .
85 28 448 1/1987 (DE) .
1067393 5/1967 (GB) .

OTHER PUBLICATIONS

Warum der PERI–Trager ein Gittertrager ist. (1 page) (undated).
Slab Formwork For Flat Framing, Ulma (undated).
Advertisement in the magazine "The Builder", Nov. 2, 1962, p. 65.
Brochure "DOKA", 1993, p. 11.05.
Steidle, Deckenschalung System Steidle–Compact Lift, Emil Steidle GmbH & Co., 1983.

* cited by examiner

*Primary Examiner*—James P. Mackey
(74) *Attorney, Agent, or Firm*—Samuels, Gauthier & Stevens

(57) ABSTRACT

The invention relates to a formworking ceiling system in which a number of supports are erected at a distance from each other, wherein respectively a partial number thereof are to be arranged in alignment with one another and on which respectively longitudinal carriers and on these again transverse carriers are placed so that the transverse carriers lie respectively on at least two longitudinal carriers and finally, formwork panels are placed on the transverse carriers. The system is characterized in that the supports, longitudinal carriers and transverse carriers are located in such a manner that for all ceiling thicknesses up to a predetermined ceiling thickness to be concreted, the respective spacings of the transverse carriers and of the longitudinal carriers as well as of the supports are complied with by means of optically and/or mechanically effective, fixed location aids applied onto the longitudinal carriers and the transverse carriers and/or the formwork panels and/or the supports.

4 Claims, 3 Drawing Sheets

CEILING FORMWORKING SYSTEM FOR FORMING CEILINGS

DESCRIPTION OF THE INVENTION

The invention relates to a method of formworking ceilings system in which a number of supports are erected at a distance from each other, wherein respectively a partial number thereof are to be arranged in alignment with one another and on which respectively longitudinal carriers are on these again transverse carriers are placed so that the transverse carries lie respectively on at least two longitudinal carriers and, finally, formwork panels are placed on the transverse carriers. Additionally, the invention relates to a ceiling formwork system with a plurality of supports, longitudinal and transverse carriers and formwork panels.

A process of the type mentioned above is long known for making ceilings of concrete. In this, supports are placed in locations previously determined on the basis of calculation tables. Subsequently, longitudinal carriers are placed on these, so that these lie substantially parallel to each other, and the spacings of these are also read from calculation tables. Furthermore, transverse carriers arranged parallel to each other are placed on these longitudinal carriers essentially perpendicular thereto and at spacings again determined from calculation tables. Finally, formwork panels are laid in such a manner on the transverse carriers that their longer sides come to lie perpendicular to the longitudinal direction of the transverse carriers.

However, the problem exists in this known process that the location at which to place the supports and the spacings with respect to each other of longitudinal carriers and the transverse carriers must be determined by means of the relatively complicated calculation tables with reference to the ceiling formwork elements used. Here, ceiling formwork elements mean the supports, the longitudinal and transverse carriers and the formwork panels.

As the necessary duty of care is often not observed on construction sites when reading the calculation tables, or the workers do not have the necessary qualifications for this, there exists the danger that the maximum spacings to be observed are possibly exceeded, which can result in insufficient support when concreting the ceiling with the possible danger of collapse. Additionally, on the construction site, the type of support, transverse and longitudinal carriers and formwork panels must be taken into account in accordance with the calculation tables, which leads to a number of calculation tables and a further complication in determining or deciding on the spacings between the individual elements.

The technical problem forming the basis of the invention is to provide a method for formworking ceilings in which, depending on the ceiling thickness to be concreted—up to a maximum ceiling thickness—an exceeding of the maximum spacings of the individual elements with respect to each other is avoided or even eliminated. Additionally, a technical problem forming the basis of the invention lies in providing a suitable ceiling formwork system for carrying out the method.

The technical problem forming the basis of invention is solved in that the supports and the longitudinal and transverse carriers are located in such a manner that the respective spacings of the transverse carriers and of the longitudinal carriers as well as of the supports for all ceiling thicknesses to be concreted up to a predetermined ceiling thickness are complied with by means of optically acting and/or mechanically mounted, fixed location aids on the longitudinal and the transverse carriers and/or the supports and/or the formwork panels.

Additionally, a ceiling formwork system for carrying out the method is provided comprising supports, formwork panels and transverse and longitudinal carriers having at least on the lower side in the built-in position thereof optically and/or mechanically effective location aids arranged in parallel with the same spacing between each other.

The invention is based on the concept of simplifying the formworking of ceilings in such a manner that complicated calculation tables are no longer necessary for determining the spacings of the individual elements with respect to each other. In accordance with the invention, for the first time, the location of the individual elements can be standardized independently of the ceiling thickness to be concreted—naturally up to a maximum ceiling thickness which is fixed by the maximum supporting strength of the elements—in that the spacings to be complied with are clearly predetermined by the optically and/or mechanically effective, securely applied location aids on the longitudinal and transverse carriers and/or the formwork panels. In this manner, when erecting the ceiling formwork, an exceeding of the maximum spacings which may result in a latent risk of collapse in greatly reduced or prevented. Additionally, it is possible for the first time with the ceiling formwork system according to the invention to control the preset distances in the erected state without any difficulties. This is the case because an incorrectly positioned element can be immediately recognized without further auxiliary means on account of the location aids. On the contrary, in the state of the art, the individual spacings had to be checked on a test basis with a metric measure which in turn results in a certain insecurity. This can now be replaced by a simple control observation, which itself results in a large gain in time and greater security.

The safety of the ceiling formwork is greatly increased on account of the inventive method or the inventive ceiling formwork system. Additionally, it is a big advantage of the method according to the invention that the assembly is linked with a considerable saving of time. In the inventive method, when a very low ceiling thickness is to be concreted, the maximum possible spacing between the individual elements is not reached and more material is therefore used than is absolutely necessary, but this additional input of material and the costs thereof does not bear any relation to the time gained in erecting the ceiling formwork. This is the case because the additional costs resulting from the higher material input are less by a multiple factor than the cost savings made on account of the shorter expenditure of time. It has been proven on the basis of several practically evaluated ceiling formworks that the material input increased on average by merely 5% for ceiling thicknesses of up to approximately 30 cm.

Thus, as a result of the inventive method or ceiling formwork system, a considerable gain is made in simplicity, expediency and safety in comparison to the known method.

Advantageously, the respective spacings of the transverse and longitudinal carriers as well as of the supports are determined in accordance with the maximum ceiling thickness to be concreted which is calculated in consideration of the geometry and material data of the formwork panels, the transverse and longitudinal carriers and the supports. In this manner, the maximum carrying capacity of the individual formwork system elements is made possible up to a maximum ceiling thickness.

It is particularly advantageous that the location of the formwork elements ensures by means of location aids respectively applied at least on the lower side of the transverse and longitudinal carriers and/or the formwork panels in the built-in position, on account of which the required spacings are already clearly predetermined for a worker.

Colored markings arranged in parallel on the formwork elements can be applied in a very easy and cost-effective manner. Additionally, such markings or location aids do not weaken the individual elements of the system.

On account of the inventive alternatively colored markings, the erection of the formwork elements and their positioning with respect to one another is very advantageously simplified, as erroneous spacings are excluded with the highest probability on account of the clear markings for positioning the elements. Thus, for example, the markings can be the same at interval of 1 m. For example, this means that a location aid line can be provided every 0.5 m from the end face of a transverse or longitudinal carrier, which lines have a different color, shape or the like.

It is particularly advantageous when mechanical location aids are provided on the supports, longitudinal and transverse carriers and possibly also on the formwork panels at the required spacing and in which aids the respectively superimposed formwork elements engage in each other. In this manner, falling below the predetermined spacings is avoided with the greatest reliability. Thus, it is possible, for example, that for receiving a longitudinal carrier in their respective supporting head, the supports have a small elevation which can fit into an appropriately adapted depression in the longitudinal carrier. In this manner, a location of the carriers at an inadmissible spacing is not even possible. In this case, the other formwork elements also have correspondingly adapted elevations or depressions on their upper and lower sides. Additionally, the possibility exists to combine optically and mechanically effective location aids on the formwork elements. Thus, it is possible, for example, to apply optical location aids on the formwork panels and to equip the remaining elements with mechanical location aids.

The use of supports which are adjustable in height and have the same support strength independently of the preset height is particularly advantageous in the ceiling formwork system according to the invention because this means that independently of the level above the base at which the ceiling is to be formed, the same inventive longitudinal and transverse carriers and formwork panels can be used with the respective optically and/or mechanically effective location aide securely applied thereon.

Particularly advantageous are cone-shaped depressions or corresponding elevations on the individual ceiling formwork elements, as this results in the superimposed elements being automatically centered in the middle.

For further explanation and better understanding of the invention, several exemplary embodiments are described and explained in more detail in the following with reference to the enclosed drawings, in which:

DESCRIPTION OF THE PREFERRED EMBODIMENT(S)

Figure 1:
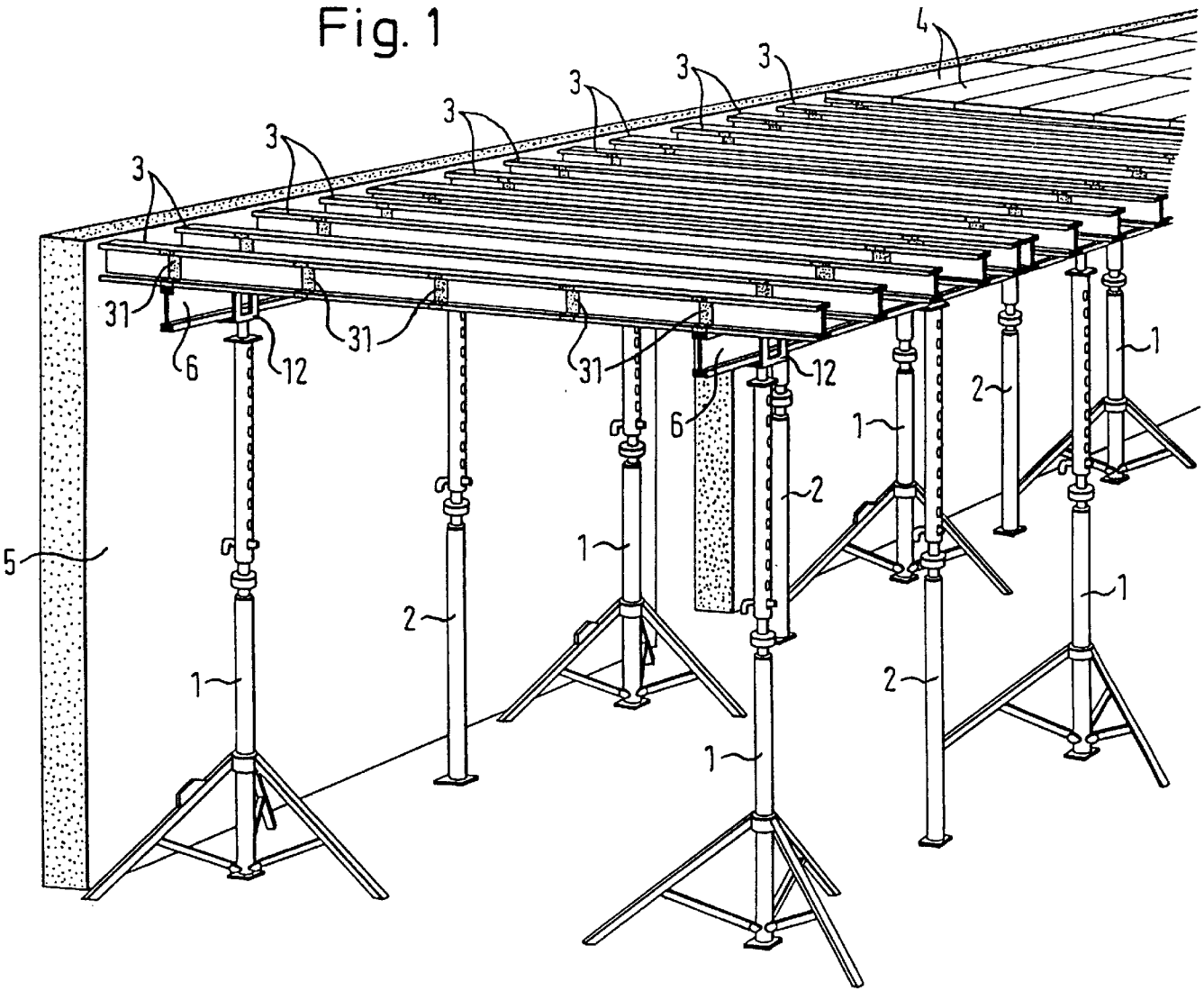
FIG. 1 shows a three-dimensional view of a ceiling formwork system according to the invention with some formwork panels laid on the transverse carried.

A ceiling formwork system according to a first exemplary embodiment of the invention is illustrated in FIG. 1 in the erected state. Supports 1 which have a spreadable foot are erected at a distance from each other. In this case, a specified number of the supports 1 respectively form a support for longitudinal carriers 6 which are mounted in the holding heads 12 of the individual supports 1. Transverse carriers 3 are laid on these longitudinal carriers 6 perpendicularly thereto. The transverse carriers 3 in this case are respectively parallel to one another on the longitudinal carriers 6 and arranged substantially perpendicular to the longitudinal carriers 6. In this condition shown in FIG. 1, some formwork panels 4 are laid on the transverse carriers 3 such that the longer sides of the formwork panels 4 lie perpendicular to the longitudinal axis of the transverse carriers 3.

Intermediate supports 2 which also support the longitudinal carriers 6 are respectively arranged between the supports 1.

Colored location aids which are not shown in this depiction are provided on the lower side of the cord of the longitudinal carriers 6 in this exemplary embodiment. The supports 1 and 2 are respectively erected at the positions indicated by the colored location aide.

The transverse carriers 3 have optically effective, colored location aids 31 arranged at a distance from each other at predetermined positions. For example, the location aids 31 on the transverse carriers 3 can be applied at 0.5 m spacings from the ends, these are alternating differently optically effective location aids 31. The longitudinal carriers 6 are then to be provided at predetermined positions on the location aids 31.

In this exemplary embodiment, a longitudinal carrier 6 is to be arranged at the first location aid 31 of the transverse carrier 3 parallel to a wall 5 against which the transverse carriers 3 abut with their end faces. The longitudinal carrier 6 to be arranged parallel to this is then arranged at a distance of four location aids 31 from this longitudinal carrier nearest the wall 5.

Figure 2:
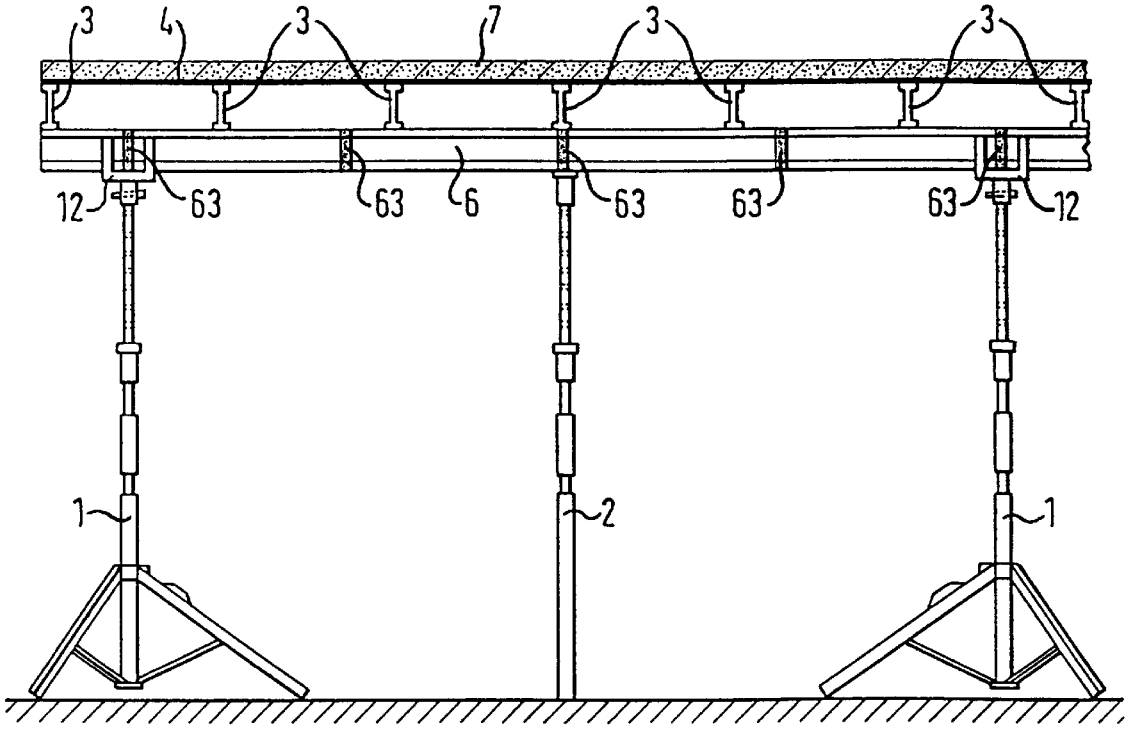
FIG. 2 shows a side view of an erected ceiling formwork in which the location aids are particularly visible on the longitudinal carriers.

A side view of an erected inventive ceiling formwork is shown in FIG. 2 in which the location aids 63, contrasted by color, are visible on the longitudinal carrier 6 at regular distances from each other. Transverse carriers 3 lie parallel to each other on the longitudinal carriers 6 and formwork panels 4 are arranged on these. Additionally, the already concreted ceiling 7 can be seen. The longitudinal carriers 6 are in this case supported at the colored or optically effective location aids 63 by the supports 1 and 2.

In this case of the transverse carriers 3 and the longitudinal carriers 6 being built the same, the optically effective locations aids 31, 63 are applied at regular intervals on the transverse carriers 3 or the longitudinal carriers 6, respectively.

Thus, in this exemplary embodiment, the spacings of the supports 1, 2 at the longitudinal carrier 6 amount to two division units, i.e. the longitudinal carrier 6 is to be supported by one support 1 or 2 at every second location aid 63. The spacings of the longitudinal carriers 6 amount in this exemplary embodiment to four divisional units which, with reference to the location aids 31 on the transverse carriers 3, implies that the longitudinal carriers 6 are arranged at every fourth location aid 31 of a transverse carrier 3. The carrier spacing of the transverse carriers 3 amounts in this exemplary embodiment to approximately 0.5 m, which implies that location aide are applied on the formwork panels 4 on the underside of the formwork panels, as will still be explained with respect to FIG. 3. The supporting arm, i.e. the length of support along a longitudinal carrier 6 or a transverse carrier 3 amounts at a maximum to the spacing of a location aid 31 or 63, respectively.

Figure 3:
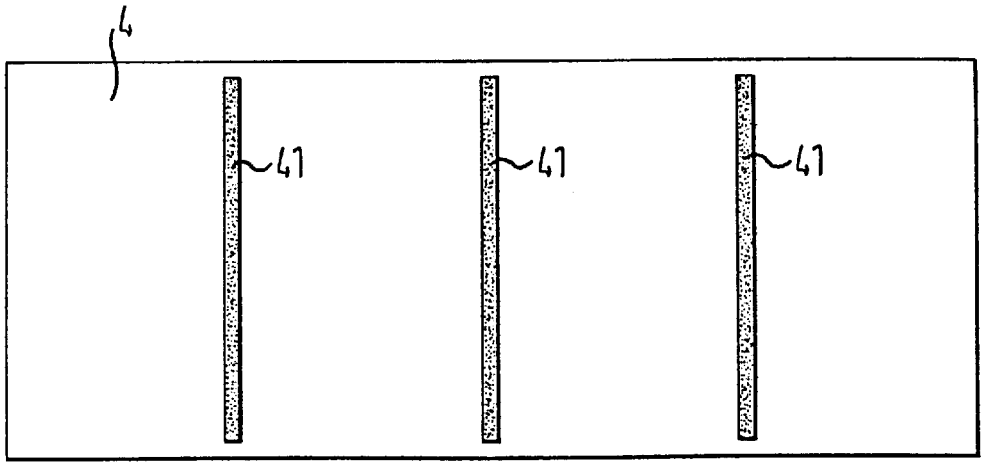
FIG. 3 shows a bottom view of an inventive formwork panel with location aids applied thereon.

FIG. 3 shows the underside of a formwork panel 4 with optically effective location aide 41 arranged at distances from each other in parallel and which serve in a distinctive manner for the positioning of the transverse carriers 3. The location aids 41 can again comprise optically effective and mechanically applied markings which are very durable even in the case of rougher building operations and soiling due to concrete being poured on these.

This also applies to the location aids 31, 63 on the transverse carriers 3 or the longitudinal carriers 6 which, for example, are produced by burning these into the wood of the transverse carriers 3 and the longitudinal carriers 6. However, for example, especially applied marking plates or the like which are resistant to mechanical influence can fulfill the same function.

Figure 4:
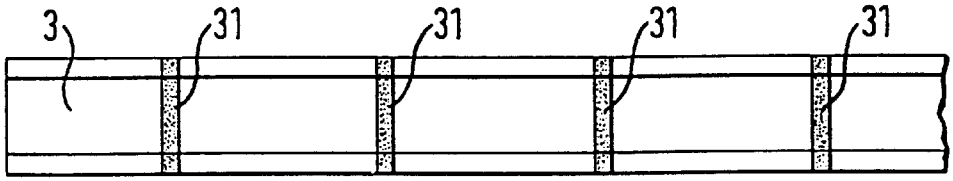
FIG. 4 shows a longitudinal carrier or also a transverse carrier according to the invention with location aids applied thereon in accordance with the invention.

The side view of a transverse carrier 3 in again shown in FIG. 4 with regularly spaced location aids 31. In this exemplary embodiment, the location aids 31 extend around the entire periphery in a partial region of the outer wall of the transverse carrier 3. However, it is equally possible to apply these only on the lower side of the cord of the transverse carrier 3. The illustration shown in FIG. 4 applies equally to a longitudinal carrier 6.

Figure 5:
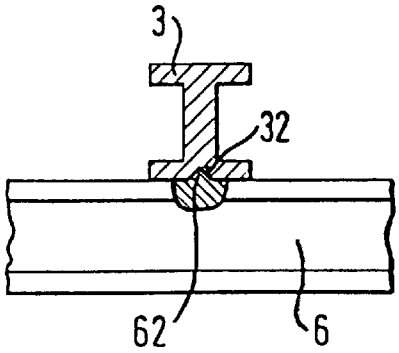
FIG. 5 shows a cross section through a transverse carrier and a longitudinal carrier located beneath this according to a further exemplary embodiment of the invention.

A cross section through a transverse carrier 3 and a longitudinal carrier 6 lying beneath this according to a further exemplary embodiment of the invention is shown in FIG. 5. The transverse carrier 3 has at its lower cord side a conical depression 32 into which the corresponding formed cone-shaped elevation 62 of the longitudinal carrier 6 can be fitted. Thus, in erecting the ceiling form, the support positions of the longitudinal carrier 6 and those of the transverse carrier 3 can be determined without problems or doubt. These mechanically effective and substantially form-locked depressions 61 and elevations 62, respectively, are to be applied at the same intervals an in the exemplary embodiments according to FIGS. 1 to 4.

Figure 6:
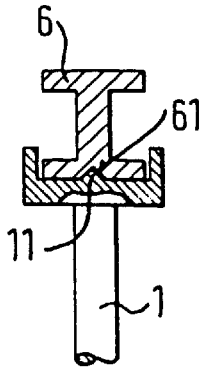
FIG. 6 shows a cross section through a longitudinal carrier which is supported on a support according to the invention.

A cross section through a longitudinal carrier 6 and a partially broken away support 1 beneath this is shown in FIG. 6. As can be seen in this illustration, the longitudinal carriers 6 are again provided with a conical depression 61 into which a cone-shaped elevation 11 of the support engages. The conical depressions 61 on the longitudinal carrier 6 are again formed into the lower side of a cord of the longitudinal support 6, wherein the same spacings are to be provided as already described in respect of the preceding exemplary embodiments.

When the entire ceiling formwork system is erected, the overseer can with a simple control observation examine the correct spacings of the individual elements such as supports 1, 2, longitudinal carriers 6 and the transverse carriers 3 an in the case of correct positioning, the respectively associated optical location aids 31, 41, 63 are substantially covered either by the formwork elements 1, 2, 3, 6—of these are applied to the underside of the elements 1, 2, 3, 4, 6—or the associated ceiling formwork elements 1, 2, 3, 4, 6 must lie substantially in the area of these location aids 31, 41, 63. This equally applies in the case of the mechanically effective location aids 11, 32, 61, 42 which in an incorrect position are obviously not correctly engaged or clearly wrongly located.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what I now claim is:

1. A ceiling formwork system which comprises:

a plurality of supports having a top portion, the support optionally having optically effective fixed location aids applied at regular intervals on at least the top portion;

longitudinal carriers having a bottom portion received on the supports, the longitudinal carrier having optically effective fixed location aids applied at regular intervals on at least the bottom portion of the longitudinal carriers;

transverse carriers having a bottom portion received on the longitudinal carriers such that the longitudinal axis of the transverse carrier is substantially perpendicular to the longitudinal carriers, the transverse carriers having optically effective fixed location aids applied at regular intervals on at least the bottom portion of the transverse carriers;

formwork panels having a bottom portion, the bottom portion of the formwork panels received on the transverse carriers; the formwork panels optionally having optically effective fixed location aids applied at regular intervals on at least the bottom portion of the formwork panels;

whereby the formwork system is assembled with the positions of the longitudinal and transverse carriers and optionally the supports and optionally the formwork panels based on the location aids.

2. The ceiling formwork system of claim 1 wherein the location aids are color contrasted markings.

3. The ceiling formwork system of claims 1 or 2 wherein the location aids are marking lines.

4. The ceiling formwork system of claim 1 wherein the supports are adjustable in height and always have a constant carrying capacity independent of the adjusted height.

* * * * *